United States Patent [19]

Mae et al.

[11] Patent Number: 4,889,170

[45] Date of Patent: Dec. 26, 1989

[54] HIGH STRENGTH TI ALLOY MATERIAL HAVING IMPROVED WORKABILITY AND PROCESS FOR PRODUCING THE SAME

[75] Inventors: Yoshiharu Mae, Urawa; Tsutomu Oka, Omiya; Atsushi Hirano, Kitamoto, all of Japan

[73] Assignee: Mitsubishi Kinzoku Kabushiki Kaisha, Tokyo, Japan

[21] Appl. No.: 874,099

[22] Filed: Jun. 13, 1986

[30] Foreign Application Priority Data

Jun. 27, 1985 [JP] Japan ..... 60-139067

[51] Int. Cl.[4] ..... C22F 1/18; C22C 14/00

[52] U.S. Cl. ..... 148/407; 148/12.7 B; 420/420

[58] Field of Search ..... 420/420; 148/12.7 B, 148/407, 421

[56] References Cited

U.S. PATENT DOCUMENTS

| | | | |
|---|---|---|---|
| 2,754,203 | 7/1956 | Vordahl | 420/420 |
| 2,893,864 | 7/1959 | Harris et al. | 420/420 |
| 3,405,016 | 10/1968 | Jaffee et al. | 148/133 |
| 3,595,645 | 7/1971 | Hunter et al. | 420/420 |
| 3,615,378 | 10/1971 | Bamberger, Jr. et al. | 420/420 |
| 3,986,868 | 10/1976 | Crossley | 420/420 |
| 4,197,643 | 4/1980 | Burnstone et al. | 420/420 |

FOREIGN PATENT DOCUMENTS

| | | | |
|---|---|---|---|
| 2747558 | 11/1978 | Fed. Rep. of Germany . | |
| 174795 | 9/1965 | U.S.S.R. . | |
| 419344 | 3/1974 | U.S.S.R. | 420/420 |
| 473451 | 9/1975 | U.S.S.R. . | |
| 772339 | 4/1957 | United Kingdom . | |
| 782148 | 9/1957 | United Kingdom . | |
| 1098217 | 1/1968 | United Kingdom . | |
| 1288807 | 9/1972 | United Kingdom . | |
| 1356734 | 6/1974 | United Kingdom . | |
| 1479855 | 7/1977 | United Kingdom . | |

OTHER PUBLICATIONS

Reinsch et al., "Three Recent Developments in Titanium Alloys", *Metals Progress*, Mar. 1980, pp. 64–70.

*Primary Examiner*—Robert McDowell

*Attorney, Agent, or Firm*—Frishauf, Holtz, Goodman & Woodward

[57] ABSTRACT

Herein disclosed are a high-strength Ti alloy material having improved workability which contains 2–5% Al, 5–12% V and 0.5–8% Mo (the percents being on a weight basis) and which satisfies the relation: $14\% \leqq 1.5 \times (\text{V content}) + (\text{Mo content}) \leqq 21\%$, with the balance being Ti and incidental impurities, and a process for producing such high -strength Ti alloy material.

The process comprises: preparing a Ti alloy ingot having the above specified composition; hot working the ingot at a temperature wihtin the range of 600°–950° C.; subjecting the work to solid solution treatment at a temperature in the range of 700°–800° C.; and age-hardening the work at a temperatrue between 300° and 600° C. The reesulting Ti alloy material is suitable for use in the fabrication of parts of aircraft where high specific strength and heat resistance are required.

4 Claims, No Drawings

HIGH STRENGTH TI ALLOY MATERIAL HAVING IMPROVED WORKABILITY AND PROCESS FOR PRODUCING THE SAME

TECHNICAL FIELD

The present invention relates to a high strength Ti alloy material which is suitable for use in the fabrication of aircraft parts where high specific strength and heat resistance (resistance to oxidation) are required and which can be readily shaped into such aircraft parts by hot and cold working. The present invention also relates to a process for producing such high-strength Ti alloy material.

BACKGROUND ART

Aircraft jet engines is one of the fields where high strength, high resistance to oxidation and good hot workability are required to be displayed in a balanced way. In such applications, two types of Ti alloy materials have been used: $\alpha+\beta$ type Ti alloy materials typified by the composition of Ti-6% Al-4% V, and semi-$\alpha$ type Ti alloy materials which have the composition of Ti-8% Al-1% V-1% Mo with the greater part of the structure being composed of the $\alpha$-phase. The hot workability of the second type of Ti alloy material is not as good as the first type. Neither $\alpha$-type nor $\alpha$-type Ti alloy materials have been employed in parts of jet engines because the $\alpha$-type Ti alloy materials are poor in strength and hot workability, while the $\beta$-type Ti alloy materials have low resistance to oxidation.

The Ti-6% Al-4% V and Ti-8% Al-1% V-1% Mo alloy compositions are conventionally manufactured by the following steps: hot working at temperatures not lower than 850° C. (≧900° C. for the first composition and ≧950° C. for the second composition); annealing; solid solution treatment at temperatures not lower than 950° C; and age-hardening at temperatures within the range of 500°-600° C. The age-hardening step is conducted only for the manufacture of the first type of Ti alloy materials, and is not performed in the production of the second type of Ti alloy material since the age hardenability is very small.

As mentioned above, the manufacture of the conventional $\alpha+\beta$ type Ti alloy materials and semi-$\alpha$ type Ti alloy materials involves a hot-working step which is performed at temperatures not lower than 850° C. Therefore, if one wants to obtain a forged product by isothermal forging which is close to the shape and dimensions of the final product, it is necessary to employ an expensive mold that has high heat resistance and which has an intricate and smooth inner surface corresponding to the shape of the final product.

Elevated temperatures are required not only in the hot working step but also in the step of solid solution treatment of the conventional $\alpha+\beta$ type and semi-$\alpha$ type Ti alloy materials, and this impairs the thermal economy of the overall process while causing the disadvantage of scale formation.

Under the circumstances described above, the present inventors made concerted efforts to develop a Ti alloy material that can be hot-worked and subjected to solid solution treatment at temperatures lower than those required in the conventional techniques and which can additionally be age-hardened to attain high strength. As a result, the inventors have found the following: a Ti alloy which contains 2-5% Al, 5-12% V and 0.5-8% Mo (the percents being by weight) and which satisfies the relation: 14%≦1.5×(V content)+(Mo content)≦21%, with the balance being Ti and incidental impurities, exhibits the $\alpha+\beta$ structure at fairly low temperatures (e.g. 700° C.) and the volume ratio of the $\alpha$-phase to $\beta$-phase close to 1:1; the Ti alloy can be readily hot-worked at temperatures lower than those which are conventionally required; in addition, the alloy can be subjected to solid solution treatment at temperatures lower than those which have heretofore been required; furthermore, in spite of its composition, which is based on the Ti-Al-V-Mo system, this alloy can be age-hardened unlike the conventional Ti-8% Al-1% V-1% Mo alloy; and the strength of the age-hardened alloy is comparable to or greater than that of the conventional age-hardened Ti-6% Al-4% V alloy.

SUMMARY OF THE INVENTION

The present invention has been accomplished on the basis of these findings. In one aspect, it provides a high strength Ti alloy material having improved workability which contains 2-5% Al, 5-12% V and 0.5-8% Mo (the percent being on a weight basis) and which satisfies the relation: 14% ≦1.5×(V content)+(Mo content)≦21%, with the balance being Ti and incidental impurities. In another aspect, the present invention provides a process for producing a high strength Ti alloy material having improved workability, which comprises:

preparing a Ti alloy ingot which contains 2-5% Al, 5-12% V and 0.5-8% Mo (the percent being on a weight basis) and which satisfies the relation: 14%≦1.5×(V content)+(Mo content)≦21%, with the balance being Ti and incidental impurities;

applying final hot-working to the ingot at a temperature within the range of 600°-950° C.;

subjecting the wrought ingot to solid solution treatment at a temperature in the range of 700°-800° C.; and age-hardening the work at a temperature within the range of 300°-600° C.

DETAILED DESCRIPTION OF THE INVENTION:

The criticality of the composition of the Ti alloy material of the present invention and that of the conditions for its fabrication are described below.

(I) Composition (a) Aluminum:

The aluminum component has the ability to reinforce the $\alpha$-phase. If the Al content is less than 2%, the strength of the $\alpha$-phase and, hence, the overall strength of the Ti alloy material cannot be held at a desired level. If the Al content exceeds 5%, V and Mo which are stabilizing elements serving to hold the B-transformation point at a low level must be added in increased amounts, which only results in a Ti alloy material having deteriorated hot workability (as is evidenced by increased deformation resistance and the need for using a large forging press). Therefore, in the present invention, the aluminum content is limited to lie between 2 and 5%.

(b) Vanadium:

The vanadium component has the ability to hold the $\beta$-transformation point at a low level and to expand the region where a stable $\beta$-phase forms. In addition, vanadium is capable of reinforcing the $\beta$-phase without greatly impairing the ductility of the Ti alloy material although this ability of vanadium is not as great as molybdenum. If the vanadium content is less than 5%, the β-transformation point cannot be held low and, furthermore, it becomes impossible to provide a nearly equivolumetric mixture of α- and β-phases at about 700° C., with the result that the required temperatures for performing hot working and solid solution treatment are not much lower than those employed in the conventional techniques. On the other hand, if the vanadium content exceeds 12%, the hot workability of the Ti alloy material is deteriorated (as evidenced by increased deformation resistance and the need for using a large forging press). Therefore, the vanadium content in the present invention is limited to lie between 5 and 12%.

(c) Molybdenum:

The molybdenum component is capable of both reinforcing the β-phase and expanding the region of β-phase stabilization while holding the β-transformation point at low level. If the molybdenum content is less than 0.5%, the intended reinforcement of the β-phase and, hence, the increase in the overall strength of the Ti alloy material are not attained. If, on the other hand, the molybdenum content exceeds 8%, the ductility of the Ti alloy material is reduced. Therefore, the molybdenum content in the present invention is limited to lie within the range of 0.5–8%.

(d) 1.5×(V content)+(Mo content):

As mentioned above, both Mo and V are elements which serve to stabilize the β-phase. However, V is a more effective β-phase stabilizer and its ability is 1.5 times as great as Mo. This is why the 1.5×(V content)+(Mo content) is critical for the purposes of the present invention. If the value of 1.5×(V content)+(Mo content) is less than 14%, the β-transformation point lowers insufficiently and the temperatures required for hot working and solid solution treatment are not much lower than those employed in the conventional techniques. If, on the other hand, the value of 1.5×(V content)+(Mo content) exceeds 21%, the hot workability of the Ti alloy material is deteriorated (as evidenced by increased deformation resistance and the need for using a large forging press). Therefore, according to the present invention, the value of 1.5×(V content)+(Mo content) is not smaller than 14% and is not larger than 21%.

(II) Process Conditions (a) Hot-working temperature:

The Ti alloy ingot having the composition specified in (I) is subjected to hot working procedures such as hot forging, hot rolling, and hot extrusion. If the temperature for hot working is less than 600° C., recrystallization will not readily occur and an increased deformation resistance results. If, on the other hand, the temperature for hot working exceeds 950° C., not only does the undesirable coarsening of the crystal grains occur but also an expensive mold is necessary for performing isothermal forging. Therefore, according to the present invention, the finishing temperature of the hot working step is limited to lie within the range of 600°–950° C. If there is a need to eliminate the cast structure, the ingot is preferably hot-worked at a temperature close to or exceeding 900° C. In the finishing step of hot working, temperatures within the range of 650°–750° C. are preferable in view of the ease of hot working. This is because the Ti alloy of the present invention, when held within the temperature range of 650°–750° C., has a mixture of α- and β-phases at a volume ratio of approximately 1:1 which is suitable for hot working.

(b) Annealing:

The annealing step is not essential and may optionally be performed before cold working if it is effected at all. Desirable annealing conditions are: temperatures in the range of 650°–750° C. and a duration of 0.5–2 hours.

(c) Temperature for solid solution treatment:

The hot-worked Ti alloy material or the one which has been cold-worked after optional annealing subsequent to hot working is then subjected to solid solution treatment which must be performed in the temperature range of 700°–800° C., which is lower than the range heretofore used in the conventional techniques. If the temperature for solid solution treatment is less than 700° C., aluminum which is an α-phase stabilizing element will not dissolve sufficiently in the β-phase and the desired strength cannot be attained even if the alloy is age-hardened in the subsequent step. If, on the other hand, the temperature for solid solution treatment exceeds 800° C., the temperature either exceeds or comes so close to the B-transformation point that the amount of the initially precipitating α-phase becomes too small to provide a homogeneous structure. It suffices that solid solution treatment is continued for the duration of the period during which the work can be heated uniformly.

(d) Temperature for age hardening:

If the temperature for age hardening is less than 300° C., the rate of diffusion is too slow to cause precipitation of the fine-grained α-phase in the β-phase and the work cannot be age-hardened. If, on the other hand, the temperature for age hardening exceeds 600° C., overaging occurs and the strength of the work will drop. Therefore, according to the present invention, the temperature for age hardening is limited to lie within the range of 300°–600° C.

The duration of age hardening will vary with the temperature employed for the step but, from an economical viewpoint, the period of 0.5–10 hours is preferable.

If necessary, the annealed work may be subsequently cold-worked. If no annealing is performed, the work may be cold-worked after solid solution treatment and before age hardening.

EXAMPLES

The Ti alloy material of the present invention and the process for producing the same are hereunder described with reference to examples.

Ti alloys having the compositions shown in Table 1 were melted by two-stage melting in a vacuum arc melting furnace to form ingots having a diameter of 200 mm and a length of 500 mm. The ingots were hot-forged at 1,000° C. to form slabs which were 50 mm thick, 600 mm wide and 500 mm long. The slabs were then hot-rolled at 720° C. into plates 3 mm thick. The rolled plates were checked for any cracking that may have developed during hot rolling. Thereafter, the plates were annealed at 700° C. for 2 hours. Samples were taken from the annealed plates and measurement of their mechanical properties was conducted. The other plates were subjected to solid solution treatment consisting of holding at 750° C. for one hour and cooling with water. Finally, the plates were age-hardened by holding them at 520° C. for 4 hours. By these procedures, Sample Nos. 1 to 10 of the Ti alloy material of the present invention and Sample Nos. 1 and 2 of the conventional Ti alloy material were produced. The mechanical properties of the final products were also measured. All the results are shown in Table 1.

TABLE 1

| | Sample No. | Composition (wt %) Al | V | Mo | 1.5 × V % + Mo % | Ti + impurities | Cracking during hot working | Mechanical properties after annealing: tensile strength (kg/mm²) | 0.2% yield point (kg/mm²) | elongation (%) |
|---|---|---|---|---|---|---|---|---|---|---|
| Ti alloy materials of the present invention | 1 | 4.3 | 6.2 | 7.4 | 16.7 | bal. | negative | 102 | 40 | 8 |
| | 2 | 4.1 | 5.2 | 7.3 | 15.1 | bal. | negative | 101 | 39 | 8 |
| | 3 | 4.2 | 5.5 | 5.9 | 14.15 | bal. | negative | 100 | 42 | 9 |
| | 4 | 4.0 | 7.1 | 6.3 | 16.95 | bal. | negative | 100 | 41 | 10 |
| | 5 | 3.7 | 8.8 | 7.6 | 20.8 | bal. | negative | 106 | 43 | 10 |
| | 6 | 3.5 | 8.6 | 4.5 | 17.4 | bal. | negative | 92 | 30 | 8 |
| | 7 | 3.2 | 7.9 | 3.9 | 15.75 | bal. | negative | 92 | 35 | 11 |
| | 8 | 3.0 | 11.1 | 2.5 | 19.15 | bal. | negative | 92 | 38 | 15 |
| | 9 | 2.5 | 10.5 | 1.1 | 16.85 | bal. | negative | 82 | 41 | 22 |
| | 10 | 2.5 | 11.1 | 0.7 | 17.35 | bal. | negative | 80 | 40 | 23 |
| prior art Ti alloy materials | 1 | 6.3 | 4.1 | — | 6.15 | bal. | positive | 105 | 95 | 12 |
| | 2 | 7.8 | 1.1 | 1.0 | 2.65 | bal. | positive | 103 | 92 | 11 |

| | Sample No. | Mechanical after age hardening: tensile strength (kg/mm²) | 0.2% yield point (kg/mm²) | elongation (%) | Elongation (%) in high-temperature tensile test: 600° C. | 700° C. | High-temperature tensile strength (kg/mm²): 600° C. | 700° C. |
|---|---|---|---|---|---|---|---|---|
| Ti alloy materials of the present invention | 1 | 126 | 122 | 6 | 190 | 480 | 20 | 5 |
| | 2 | 123 | 120 | 7 | 210 | 470 | 19 | 5 |
| | 3 | 120 | 118 | 9 | 200 | 530 | 19 | 5 |
| | 4 | 119 | 117 | 10 | 210 | 500 | 18 | 6 |
| | 5 | 128 | 125 | 8 | 170 | 550 | 21 | 4 |
| | 6 | 120 | 112 | 7 | 190 | 500 | 19 | 5 |
| | 7 | 118 | 114 | 9 | 220 | 470 | 20 | 6 |
| | 8 | 120 | 116 | 9 | 190 | 550 | 19 | 5 |
| | 9 | 112 | 104 | 9 | 210 | 510 | 18 | 6 |
| | 10 | 110 | 102 | 10 | 190 | 520 | 19 | 5 |
| prior art Ti alloy materials | 1 | 115 | 108 | 8 | 30 | 100 | 39 | 22 |
| | 2 | — | — | — | 20 | 70 | 45 | 28 |

Data in Table 1 show that sample Nos. 1 to 10 of the Ti alloy material of the present invention could be produced without experiencing any crack development during the hot working step which was carried out at a temperature as low as 720° C. At such a low temperature, the development of cracks was unavoidable in the production of comparative sample Nos. 1 and 2.

The lowest temperature at which Ti alloy materials could be hot-worked without experiencing any cracking was 600° C. for the samples of the present invention and 900° C. for the comparative samples.

Table 1 also includes data for the elongation and tensile strength, measured at 600° C. and 700° C. At 600° C., the alloy samples of the present invention exhibited an elongation of 200% and a tensile strength (resistance to deformation) as small as 20 kg/mm² and, at 700° C., they exhibited a nearly 500% elongation which could be described as superplastic elongation, and their tensile strength values at 700°°C. were extremely small (≃5 kg/mm²). This suggests the extremely high adaptability of these alloy samples to hot working such as isothermal forging. The two comparative samples had elongations of less than 30% and 100% at 600° C. and 700° C., respectively. They also displayed tensile strength values of more than 30 kg/mm² and 20 kg/mm² at 600° C. and 700° C., respectively. It is therefore clear that the comparative alloys are not highly adaptive to hot working at lower temperatures such as isothermal forging.

As is evident from these data, the Ti alloy material of the present invention is amenable to hot working at extremely low temperatures in comparison to the prior art Ti alloy materials and, hence, it can be forged in a fairly inexpensive mold. The use of low temperatures has the additional advantage that the growth of crystal grains is sufficiently inhibited to enable the production of a fine structure comprising grains with an average size of no larger than 1 μm. Because of the absence of cracking during hot working, it is possible to obtain a shape by hot working which has dimensions close to those of the final product and which does not require a lot of machining operations for finishing purposes. Therefore, the Ti alloy material produced by the process of the present invention need not necessarily be cold worked.

As is also clear from Table 1, the samples of Ti alloy material of the present invention exhibit extremely low levels of tensile strength and 0.2% yield point in the annealed state as compared with the values after age hardening. On the other hand, the annealed samples of the present invention showed high degrees of elongation. Therefore, the Ti alloy material of the present invention can be readily shaped into the final product by cold working.

Table 1 also shows that the samples of Ti alloy material of the present invention could be subjected to solid solution treatment at temperatures lower than those required for the samples of the prior art Ti alloy material (the comparative samples were subjected to solid solution treatment which consisted of holding them at 955° C. for 1 hour followed by cooling with water and, thereafter, they were age-hardened at 530° C. for 4 hours).

It is also clear from Table 1 that the samples of Ti alloy material of the present invention, after being age-hardened, exhibited values of strength and elongation which were comparable to or higher than those of the age-hardened samples of the conventional Ti alloy materials.

In the examples described above, all the samples of the present invention were annealed before solid solution treatment. It should however be understood that Ti alloy materials having the desired properties can be obtained even if the annealing step is omitted.

What is claimed is:

1. A process for producing a high strength Ti alpha-phase and beta-phase alloy material having improved workability, which comprises:

preparing a Ti alloy ingot consisting of 2–5% Al, 5–12% V and 0.5–8% Mo (the percent being on a weight basis) and which satisfies the relation: $14\% \leqq 1.5 \times (\text{V content}) + (\text{Mo content}) \leqq 21\%$, with the balance being Ti and incidental impurities;

applying final hot-working to the ingot at a temperature within the range of 600°–950° C.;

subjecting the work to solid solution treatment at a temperature in the range of 700°–800° C.; and age-hardening the work at a temperature within the range of 300°–600° C.

2. The high strength Ti alloy material having improved workability produced by the process of claim 1, said alloy having a mixed alpha-phase and beta-phase structure and consists of 2–5% Al, 5–12% V and 0.5–8% Mo (the percent being on a weight basis) and which satisfies the relation: $14\% \leqq 1.5 \times (\text{V content}) + (\text{Mo content}) \leqq 21\%$, with the balance essentially being Ti and incidental impurities.

3. A process for producing a high strength Ti alpha-phase and beta-phase alloy material having improved workability, said alpha-phase and beta-phase being in a volume ratio of about 1:1, which comprises:

preparing a Ti alloy ingot consisting essentially of 2–5% Al, 5–12% V and 0.5–8% Mo (the percent on a weight basis) and which satisfies the relation: $14\% \leqq 1.5 \times (\text{V content}) + (\text{Mo content}) \leqq 21\%$, with the balance being Ti and incidental impurities;

applying final hot-working to the ingot at a temperature within the range of 600°–950° C.;

subjecting the work to solid solution treatment at a temperature in the range of 700°–800° C.; and age-hardening the work at a temperature within the range of 300°–600° C.

4. The high strength Ti alloy material having improved workability produced by the process of claim 3, said alloy having a mixed alpha-phase and beta-phase structure wherein said alpha-phase and beta-phase are in a volume ratio of about 1:1 and consists essentially of 2–5% Al, 5–12% V and 0.5–8% Mo (the percent being on a weight basis) and which satisfies the relation: $14\% \leqq 1.5 \times (\text{V content}) + (\text{Mo content}) \leqq 21\%$, with the balance essentially being Ti and incidental impurities.

* * * * *